United States Patent [19]

Ek

[11] Patent Number: 4,506,834

[45] Date of Patent: Mar. 26, 1985

[54] METHOD AND DEVICE FOR DISPERSING MATERIAL

[75] Inventor: Bo R. Ek, Stockholm, Sweden

[73] Assignee: Fiber Dynamics AB, Stockholm, Sweden

[21] Appl. No.: 549,566

[22] Filed: Nov. 7, 1983

Related U.S. Application Data

[63] Continuation of Ser. No. 322,919, Nov. 19, 1981, abandoned.

[30] Foreign Application Priority Data

Nov. 21, 1980 [SE] Sweden ..... 8008196

[51] Int. Cl.[3] ..... B02C 19/00

[52] U.S. Cl. ..... 241/1; 34/57 R; 241/5; 241/28; 406/144

[58] Field of Search ..... 241/1, 39, 40, 5, 20, 241/28, 18, 19; 34/57 R; 406/144, 153

[56] References Cited

U.S. PATENT DOCUMENTS 2,660,564 11/1953 Davis ..... 241/39 X 3,504,945 4/1970 Leibundgut et al. ..... 406/144

FOREIGN PATENT DOCUMENTS 756694 9/1956 United Kingdom ..... 406/144

*Primary Examiner*—Mark Rosenbaum

*Attorney, Agent, or Firm*—Sherman & Shalloway

[57] ABSTRACT

The invention relates to a method and a device for dispersing fibrous material. The fibrous material is accelerated and expanded together with a flowing medium in a nozzle (10). The nozzle (10) includes a converging and a diverging section and, thus, is a so-called de Lavel nozzle.

5 Claims, 1 Drawing Figure

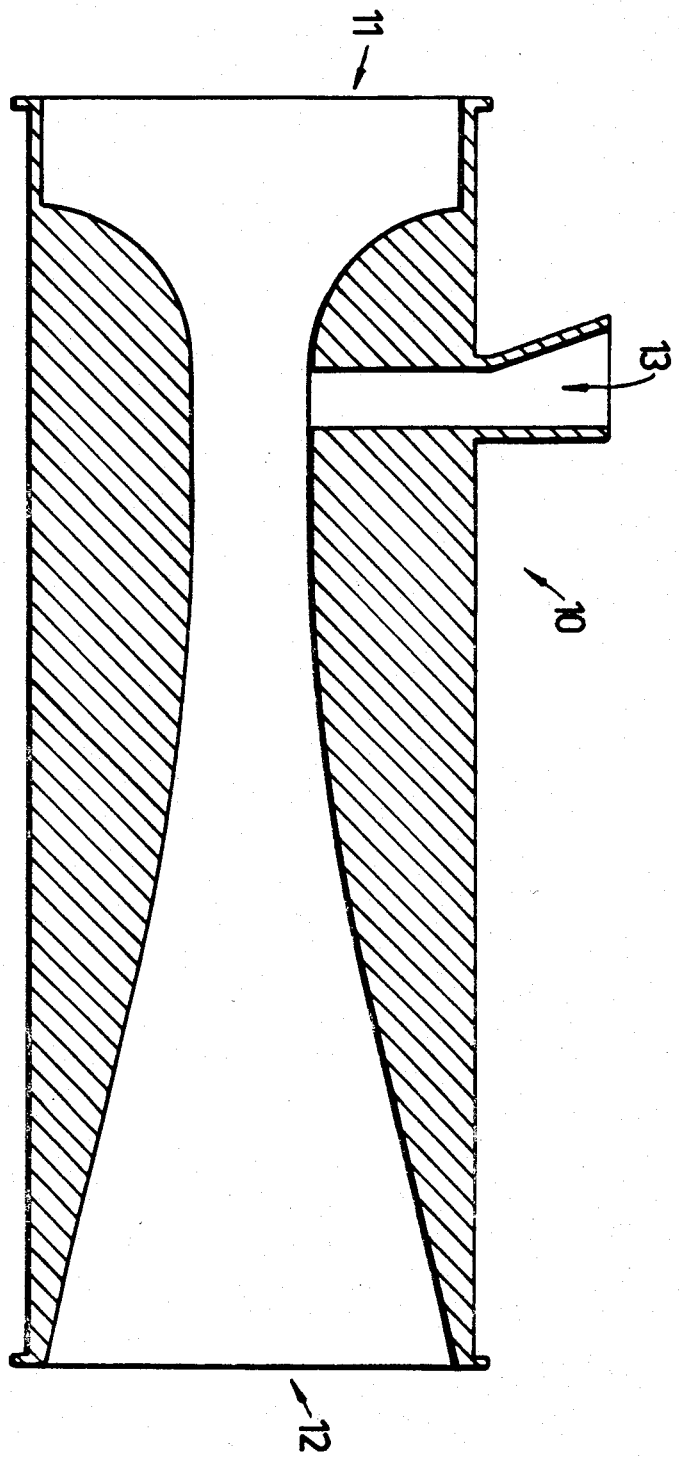
11
13
10
12

METHOD AND DEVICE FOR DISPERSING MATERIAL

This is a continuation of application Ser. No. 322,919, filed Nov. 19, 1981, now abandoned.

BACKGROUND OF THE INVENTION

This invention relates to a method and a device for dispersing material in a dry state or suspended in water to an aerosol or other three-phase system.

The invention is generally applicable and can be applied to all kinds of material, but it is especially suitable to be applied to fibrous materials, which may be difficult to disperse in gas flows.

A well-dispersed fibre aerosol is a prerequisite for rendering it possible for fibres of different kinds to be mixed in a gas-dynamic way.

When, for example, the fibres are to be dried in a flash drier, the greatest heat transfer surface is obtained when the fibres are entirely exposed. A large surface in its turn permits a lower difference in temperature between drying gas and drying material, thereby improving the efficiency degree of the drier.

All of the shredder types commercially available today and employed for dispersing fibres in flash drying plants are of a mechanical type, i.e. the papermaking pulp is disintegrated by shearing between mechanical devices. NIRO ATOMIZER sells a roll with spikes, SUNDS passes the pulp through a rotating pin wheel, and DEFIBRATOR offers disc refiners.

All these types of shredders have in common that, at the same time as they produce the disintegrating tensile and expansion forces, they also give rise to sintering compression forces. The pulp shredded for the flash drier includes single fibres, undefibrated flakes and compressed fibre packages.

The free fibres dry within some seconds in the flash drier, but the larger fibre flakes require a drying time in the drier of almost one minute. This implies that the free fibres are over-dried, their dry solid content is 100 percent while the average material has a dry solid content of 90 percent. Over-drying implies, in addition to a lower efficiency degree, also a deterioration in quality. The free fibres form spirals, and their surface gets hard.

The compressed fibre packages, which are made permanent in the drier, form knots, which are almost impossible to pulp. This problem is particularly troublesome with birch pulp and some other hardwood pulps which, therefore, today are not flash dried at all.

When the number of free fibres can be increased at the shredding operation, the drying temperature can be lowered. This reduces the effect of making the fibre packages permanent and, besides, decreases the number of fibre packages to become permanent.

The present invention relates to a gas-dynamic method of shredding papermaking pulp, hereinafter called jet shredding. The utilization of a gas as shredding medium implies, that the strongest compressing forces disappear, because gases are compressible and, therefore, have a certain "air cushion effect". In order to achieve highest possible efficiency, the following requirements must be met:

1. Great difference in velocity between gas and material. The material then is exposed to strong acceleration forces, which upon acceleration of the material tear off fibres.

2. Lower static pressure on the gas than in the fibre material. The fibre material then tends to expand apart and thereby facilitates defibration.
3. High temperature of the gas. The material is easier to disperse at increasing gas temperature, because the fibres are held together by the capillary forces of the water, which decrease at increasing temperature and are completely gone at the critical water temperature.

SUMMARY OF THE INVENTION

A fibrous material such as papermaking pulp is fed to a nozzle together with a flowing medium. The nozzle comprises a converging section and a diverging section. The pulp and flowing medium are expanded in the diverging section of the nozzle at supersonic or subsonic flow.

BRIEF DESCRIPTION OF DRAWING

The drawing shows the cross sectional view of the nozzle used in the present invention.

DETAILED DESCRIPTION OF THE PREFERRED EMBODIMENT

The characterizing feature of the present invention is that the papermaking pulp is passed into a nozzle where the pulp and the flowing medium are expanded. The nozzle comprises a converging and a diverging section, and the material is supplied at the narrowest section or immediately after the same. This type of nozzle colloquially is called de Laval nozzle, and the pressure drop can be adjusted so that an isentropic supersonic and subsonic flow is obtained. As is well known, a flow process is considered to be isentropic if it proceeds both reversibly and adiabatically, exchanging no heat with its surroundings. In this regard, see page 44 of the book *Gas Dynamics* by Cambel and Jennings, McGraw Hill Book Company, Inc., New York, N.Y., 1958. In the case of supersonic flow the diverging passageway affects the flow in such a manner, that the gas is expanded, while in the case of subsonic flow the gas there is compressed.

When the pressure drop occurs between these extremes, the diverging section at first has an expanding effect, whereafter a shock wave arises, and thereafter the gas is compressed. It is, therefore, possible in this region to obtain supersonic speed in the gas without having to apply a total pressure drop, which yields sonic speed in a converging nozzle. The diverging section, the diffusor, recovers kinetic energy to potential compression energy.

The advantage of this method over the method disclosed in U.S. Pat. No. 2,393,783, at which a pulp web is exposed to a gas flow of high speed from two directions, is, besides the lower pressure drop, the higher expansion and acceleration forces. Besides, the static pressure in the gas is higher than in the fibre material which, therefore, rather is beaten and pressed apart than expanded apart.

Experiments carried out in practice with a nozzle having rectangular cross-sectional shape have shown, that a good defibration result is obtained when a total pressure drop of 0.3 atmosphere gauge is applied over the nozzle. In the experiments, low pressure steam was used. The primary pressure of the steam was 3.2 atmosphere gauge, which renders it possible to recirculate steam over the nozzle through a thermocompressor. In this way the total steam consumption required can be reduced. Low pressure steam, besides, is available in great amounts in many processing industries.

In Tables 1, 2 and 3 the result of experiments with the jet shredder are shown where coarse shredded pulp (=the pulp fed to the jet shredder) and SUNDS fine shredded pulp are compared.

It is characteristic of the jet shredder that the screen residue is lower. The screen residue at 0 breaking revolutions is a measure of the amount of undefibrated material. The free fibre amount, thus, has increased from 50 percent to 80 percent. The screen residue at 1000 and 10,000 breaking revolutions can be said to be a measure of the pulpability. The jet shredded pulp, therefore, is easier to disintegrate. The Water Retention Value (WRV) and the number of breaking revolutions required for obtaining a certain freeness also indicate, that the processing of the pulp has become easier.

The invention is described in the following by way of an embodiment shown in the accompanying drawing.

The FIGURE is a longitudinal section of a planeparallel nozzle 10 for dispersing papermaking pulp. The nozzle 10 is designed as a de Laval nozzle with an inlet 11 to the left in the FIGURE and an outlet 12 to the right therein. At the smallest cross-section of the nozzle, or immediately thereafter, seen in the direction from the inlet 11 to the outlet 12, an infeed gap 13 opens, through which the material is fed.

The nozzle operates as follows:

A flowing medium, for example steam or air, is passed at a suitable pressure into the inlet 11 of the nozzle. In the converging section the gas is expanded so that at and about the infeed gap a static pressure is obtained which is lower than the ambient static pressure. The material, therefore, is sucked into the nozzle. Depending on the size of the pressure applied, the diverging section acts either as a diffusor or supersonic nozzle or as a mixture therebetween.

TABLE 1

| Screen residue at different numbers of breaking revolutions | | |
|---|---|---|
| number of revolutions | jet shredded (g/100 g) | fine shredded (g/100 g) |
| 0 | 20.5 | 49.2 |
| 1 000 | 4.96 | 7.26 |
| 10 000 | 0.04 | 0.04 |

TABLE 2

| WRV for different shredders | |
|---|---|
| shredder | WRV |
| jet | 120 |
| fine | 104 |
| coarse | 130 |

TABLE 3

| Pulp quality for different shredders | | | | | | |
|---|---|---|---|---|---|---|
| test | jet shredded | | Fine shredded | | | coarse shredded |
| dry solid cont. | 94 | 94 | 94 | 94 | 94 | 94% |
| drainage resist. | 25 | 45 | 25 | 45 | 25 | 45° SR |
| density | 770 | 800 | 760 | 810 | 770 | 810 kg/m$^3$ |
| tensile strength −x | 90.5 | 96.0 | 93.5 | 100.2 | 89.0 | 98.0 kNm/kg |
| bursting strength −x | 7.1 | 7.8 | 7.2 | 8.0 | 7.0 | 7.4 MN/kg |
| tearing resist. −x | 10.1 | 9.5 | 10.5 | 9.3 | 9.5 | 8.2 Nm$^2$/kg |
| scattering coeff. | 19.5 | 17.0 | 18.5 | 16.0 | 19.0 | 16.5 m$^2$/kg |
| beating revol. | 4700 | 8400 | 4650 | 9250 | 4450 | 8150 rev. |

What I claim is:

1. A method of increasing fiber separation in the flash drying of paper pulp comprising feeding a fibrous material into a nozzle having a converging inlet for a flowing medium, a feed inlet gap for the fibrous material and a diverging outlet, the feed inlet gap for the fibrous material opening into the nozzle adjacent but not upstream of the smallest cross-section of the nozzle, expanding the fibrous material together with the flowing medium in the diverging section of the nozzle to isentropic supersonic and sub-sonic flow; and supplying the expanded fibrous material and flowing medium to a flash dryer wherein the fibrous material is dried.

2. The method of claim 1 wherein the flowing medium is expanded so that at least somewhere in the nozzle sonic speed is obtained.

3. The method of claim 1 wherein the flowing medium is steam.

4. The method of claim 3 wherein the steam has a pressure of 3.2 atmosphere gauge.

5. The method of claim 1 wherein the nozzle has a rectangular cross-section and a total pressure drop of 0.3 atmosphere gauge is applied over the nozzle.

* * * * *